United States Patent [19]

Elmberg

[11] 4,415,782

[45] Nov. 15, 1983

[54] SLIDING DISC TRANSDUCER ACTUATOR

[75] Inventor: Dwayne R. Elmberg, Coon Rapids, Minn.

[73] Assignee: Sundstrand Corporation, Rockford, Ill.

[21] Appl. No.: 308,066

[22] Filed: Oct. 2, 1981

[51] Int. Cl.[3] ..... H01H 25/04

[52] U.S. Cl. ..... 200/6 A

[58] Field of Search ..... 200/6 A, 7, 17 R, 18

[56] References Cited

U.S. PATENT DOCUMENTS

| | | | |
|---|---|---|---|
| 1,809,527 | 9/1931 | Pate | 200/6 A |
| 3,401,240 | 9/1968 | Groves | 200/6 A |
| 3,666,900 | 5/1972 | Rothweiler et al. | 200/6 A |
| 3,818,154 | 6/1974 | Presentey | 200/6 A |
| 3,835,270 | 9/1974 | Dufresne | 200/6 A |
| 3,917,918 | 11/1975 | Vannest et al. | 200/6 A |
| 3,988,556 | 10/1976 | Hyodo | 200/6 A |
| 4,218,702 | 8/1980 | Brocard et al. | 200/6 A |

*Primary Examiner*—J. R. Scott

*Attorney, Agent, or Firm*—Ted E. Killingsworth; Michael B. McMurry; Harold A. Williamson

[57] ABSTRACT

A simple compact actuator mechanism for converting pivoting motion to planar motion is disclosed. The mechanism comprises a housing supporting a handle shaft for pivoting motion and supporting a disc for planar sliding motion. The disc is connected to the shaft at a point spaced from the pivot point whereby pivoting of the shaft causes translation of the disc.

20 Claims, 5 Drawing Figures

SLIDING DISC TRANSDUCER ACTUATOR

BACKGROUND OF THE INVENTION

The invention disclosed herein relates generally to actuator mechanisms for converting two axis pivoting motion to planar motion, and more particularly to an improved joystick controller mechanism utilizing a sliding disc for acutating transducers actuatable by linear motion in response to pivoting control handle motion.

Joystick or two axis control handles are used as switch or valve actuators in a variety of applications in which it is desirable or necessary to have a plurality of independent functions controlled from a single handle. Examples of such applications include controlling the angle and height of blades, scrapers, cutters, etc. on earth and snow moving machinery, controlling various airfoil surfaces on aircraft, controlling cutter position in multi-axis machine tools, and controlling electron beam position in any of a variety of types of electronic instruments. Many other applications also exist, and the types of applications and quantity of joystick controllers used in connection therewith continue to increase.

The proliferation of apparatus requiring joystick controllers has placed increasingly stringent requirements on all features of such controllers. They are required to operate reliably over a long life. At the same time, the manufacture and sale of such controllers is quite competitive. Therefore, it is necessary that any joystick controller used in significant quantities be designed for simple manufacture. Among other things, the cost restriction essentially dictates a design which utilizes a minimum number of easily assembled parts. In general, compliance with this requirement also enhances reliability and maintainability since a simple design with fewer parts is normally less prone to failures, and is easier to repair if failure occurs.

It is also desirable that a joystick controller be designed to accommodate a variety of switches, proportional electronic output devices, and/or valves. For reliability, maintainability, and availability of replacement parts, the switches, etc. should be easily separable from the actuator mechanism, and should be standard commercially available components. Accommodation of such components is faciliatated by maximizing the space in the controller which is uncommitted to other necessary features of the controller such as mechanisms for mounting the handle shaft for pivotal movement, for biasing the handle to a neutral position, and for actuating transducers in response to handle positions. Concurrent with desirability of maximizing uncommitted space, there is a continuing need to reduce the overall size of joystick controllers, and particularly to reduce the depth of such controllers and the distance they extend behind structures on which they are mounted.

A variety of mechanisms for actuating switches or other transducers which are actuatable by linear motion in response to pivoting motion are known. Many of these are specifically designed for and limited to actuation of a single switch at any one time. One type of mechanism includes only a single switch which is actuated in response to pivoting of a shaft in any direction. Such a device is shown in U.S. Pat. No. 2,612,049, issued to A. Koch, Jr. on Sept. 30, 1952. In the Koch actuator, a control stem or shaft has a rigid spacer or disc fixed to one end thereof. Pivoting of the shaft in any direction causes an edge the disc to have a component of motion parallel with the longitudinal axis of the shaft in its neutral position. This motion component is transferred by means of a suitable linkage to a switch operator which is responsive to such motion.

Another type of mechanism is known in which any one of a plurality of switches is actuatable in response to pivoting shaft motion, but only a single switch is actuatable at one time. For example, U.S. Pat. No. 2,984,720, issued to J. Fischer on May 16, 1961, discloses a control unit in which an operating rod member is mounted for pivoting movement, but is confined to pivoting about either of two orthogonal axes by a slotted plate. A separate pivotally supported level is provided for transferring rod motion to each of four switches associated with the four permitted pivoting directions of the control rod. The slotted plate is required to confine the control rod to positions which provide proper interaction with the pivoting levers. Use of the slotted plate, a plurality of separate pivoting levers and other components results in a relatively high parts count and complicated mechanism.

U.S. Pat. No. 3,666,900, issued to R. Rothweiler et al. on May 30, 1972, discloses a joystick controller having a sliding cam which interacts with translating pins adapted to move in a direction parallel with the longitudinal axis of a joystick operator arm in its neutral position. The translating pins function to operate switches of a push button type. The sliding cam is movable along either of two orthogonal axes transverse to the longitudinal axis in response to pivoting of the operator arm. Movement of the arm as transferred to the cam by a ball formed on one end of the arm which fits into a socket in the cam. The cam is configured to interact with a cavity in a housing so as to permit sliding of the cam only along a single axis at a time as necessary to prevent jamming of the cam and translating pins. This design results in a relatively deep configuration and high parts count.

U.S. Pat. No. 3,639,705, issued to W. Rayner on Feb. 1, 1972, discloses a joystick control switch in which a plurality of depressable plunger type switches are actuatable by direct contact with the sides of one end of a pivotally mounted operating lever. Pivoting of the operating lever is confined to predetermined paths by slots in a base plate as necessary to provide proper interaction between the lever and the plungers on the switches.

Certain other switch actuator designs are known which permit actuation of more than a single switch at one time in response to pivoting of a control handle depending on the components of control handle motion. For example, U.S. Pat. No. 2,391,881, issued to M. Clay on Jan. 1, 1946, discloses a crane control system in which an operating lever pivotally supported at one end actuates switches orthogonally arranged around the lever. The lever is fitted with a contact sleeve having a square cross section in the area of the switch operators so as to permit simultaneous actuation of adjacent switches depending on the direction in which the lever is pivoted. Excursion of the lever is limited by a rigid ring to prevent the sleeve from moving laterally beyond the switch locations. This design, in which the switches are located intermediate the ends of the lever, results in a deep configuration in order that the lever present a relatively linear motion to the switches.

U.S. Pat. No. 2,857,485, issued to R. Brooks on Oct. 21, 1958, discloses a multiposition electrical switch utilizing a wobble disc for bridging between a central distribution contact and one or more contacts arranged around the central contact. The wobble disc is pivotally supported by means of a hub on its lower surface which fits within a stationary recess, and is tilted by means of an operating lever having a spring loaded plunger which is received in the socket in the upper disc surface. This design requires complete integration of the electrical contacts and bridging element with the mechanical portions of the device. Thus, it is not adapted to the use of commercially available switches or other components, and cannot be used with proportional output devices.

U.S. Pat. No. 3,835,270, issued to W. Dufresne on Sept. 10, 1974, discloses a joystick control mechanism in which a printed circuit board is attached to one end of a joystick shaft and moves laterally in response to pivotal shaft motion. The board is held against laterally fixed contact elements by means of a spring. Movement of the printed circuit board causes bridging between sets of contacts by conductive paths on the board depending on position of the board. As with the Brooks multiposition switch, this design is not adapted to use of commercially available switches or other components. In addition, its suitability is limited to relatively low level electrical switching and intermittent use due to limitations on the durability of printed circuit board construction and wear caused by sliding operation between the printed circuit paths and contacts.

The applicant has devised a unique actuator motion conversion device which is exceptionally simple in design and utilizes a minimum number of parts. The design is compact and rugged, and is well adapted to accommodate a wide range of standard commercially available switches, proportional electronic output devices, valves and/or other transducers. Finally, the design minimizes the depth of mechanical portions of the actuator and permits mounting of switches, transducers, etc. in a low profile orientation.

SUMMARY OF THE INVENTION

The present invention is a simple, compact actuator mechanism for converting two axis pivoting motion to planar motion comprising support means for supporting a shaft for pivotal movement about two distinct axes transverse to the longitudinal axis of the shaft, and for supporting a generally planar disc member for sliding movement in a plane transverse to the longitudinal axis. The disc member is connected to the shaft at a point thereon spaced from the pivot point so that as the shaft is pivoted in any direction, the disc member is caused to move linearly in a corresponding direction. The disc member may comprise a flexible center web having an aperture therein which snugly receives an end of the shaft. The center web may be at least partially surrounded by a peripheral rim which is slideably confined between parallel surfaces of the support means.

DESCRIPTION OF THE PREFERRED EMBODIMENT

Figure 1:
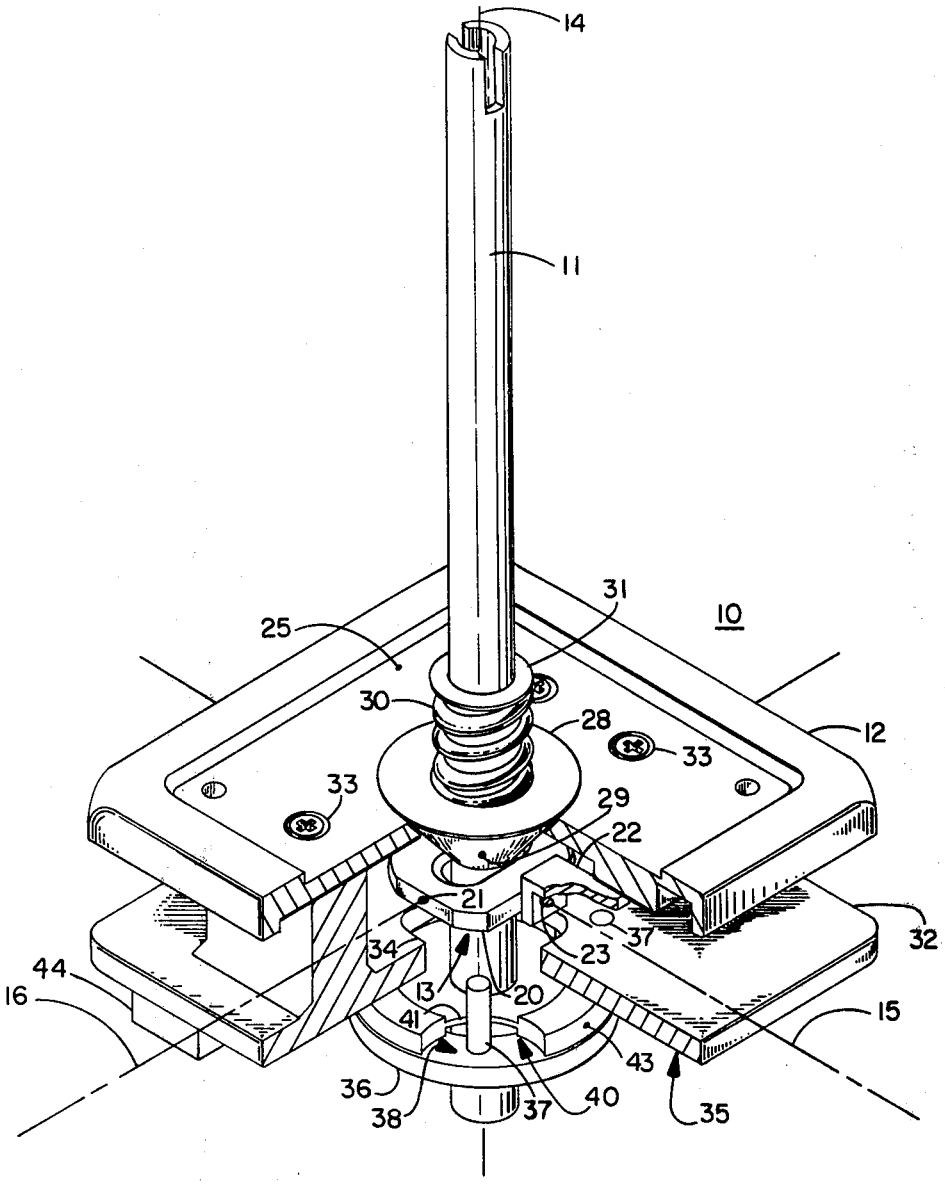
FIG. 1 is a perspective view, partially in section, of joystick apparatus embodying a motion conversion mechanism in accordance with the applicant's invention.
Figure 2:
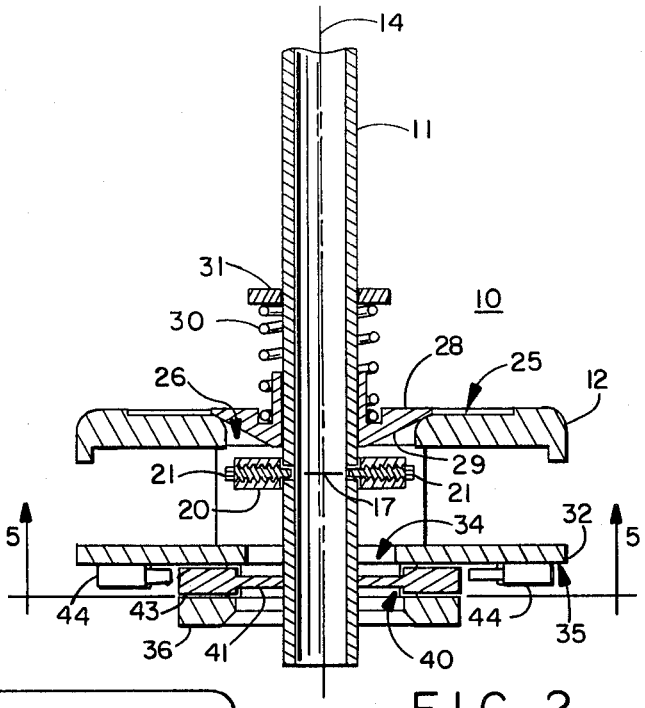
FIG. 2 is a sectional elevation view of the joystick apparatus of FIG. 1 with a handle shaft thereof in a centered position.
Figure 3:
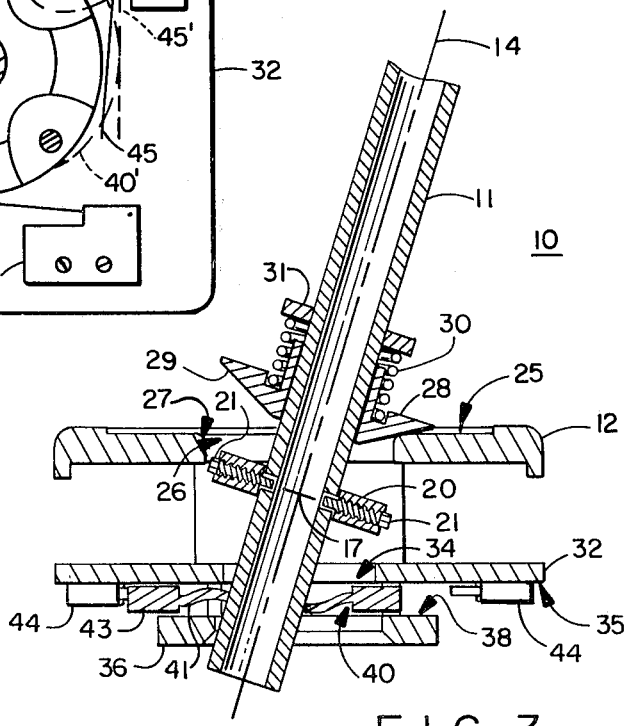
FIG. 3 is a sectional elevation view of the joystick apparatus of FIG. 1 with the handle shaft pivoted to a position of extreme excursion from the centered position.

In FIGS. 1-3, reference numeral 10 generally identifies joystick apparatus in accordance with the applicant's invention comprising a control handle shaft 11 pivotally supported in a fixed mounting structure including an upper plate 12, by means of a gimbal generally identified by reference numeral 13. Shaft 11 extends along a longitudinal axis 14, and is pivotable about axes 15 and 16 which are shown as orthogonal and transverse to axis 14, and define a pivot point thereon. In FIGS. 2 and 3, the pivot point is identified by reference numeral 17.

Gimbal 13 is exemplary of one type of mounting arrangement for permitting pivotal movement about transverse axes. It comprises a ring 20 which is pivotally connected to shaft 11 by means of suitable pivot pins 21 aligned with axis 16. Ring 20 is also pivotally mounted to plate 12 by means of brackets 22 fixed to plate 12 and suitable pivot pins 23 aligned with axis 15 pivotally supporting ring 20 in brackets 22. Accordingly, shaft 11 is permitted to independently pivot about axis 15 and 16. It should, however, be noted that although a gimbal support is illustrated, other types of supports, such as a ball and socket support, could also be utilized.

Handle shaft 11 is biased to a centered position by means of a cam surface on upper plate 12, a cam follower slideably supported on shaft 11 and a spring for biasing the cam follower toward the cam surface. This centering mechanization is the subject of a copending patent application filed concurrently with this application jointly in the names of the inventor in this application and Alan H. Eiler, and assigned to the same assignee as this application. Reference may be made to the copending application for a detailed description of the centering mechanism. However, the following brief description will aid in completing the description of the present invention.

Plate 12 has an upper surface or face 25 thereon which is spaced along axis 14 from pivot point 17. Plate 12 also has an aperture 26 therethrough surrounding axis 14 through which shaft 11 extends. Aperture 26 is circular and symmetrical about axis 14 when shaft 11 is in its centered position. A cam surface 27 is formed around the periphery of aperture 26 at its intersection with surface 25. A cam follower 28 in the form of a sleeve having a conical surface 29 thereon is mounted on shaft 11 for sliding movement along axis 14.

A coil spring 30 surrounding shaft 11 is compressed between cam follower 28 and a retainer 31 fixed to shaft 11. Spring 30 urges cam follower 28 toward pivot point 17 and cam surface 27. As shown in FIG. 3, as shaft 11 is pivoted away from the centered position in any direction transverse to axis 14, cam surface 27 causes cam follower 28 to move away from pivot point 17 against spring 30. Conversely, spring 30 in conjunction with cam follower 28 and cam surface 27 tend to return shaft 11 to the centered position.

Upper plate 12 comprises a portion of support means which also includes a lower plate 32. Plate 32 is spaced from plate 12 by columns on plate 32, and attached thereto by means of a plurality of screws 33. Lower plate 32 has an aperture 34 therethrough through which shaft 11 extends. Plate 32 also has a lower surface 35 thereon which is shown as a planar surface. A retainer plate 36 having a planar upper surface 36 thereon is mounted on but spaced from plate 32 by means of a plurality of posts 37, leaving a cavity with parallel surfaces between plate 32 and retainer 36. Planar surfaces 35 and 38 are transverse to axis 14.

Figure 4:
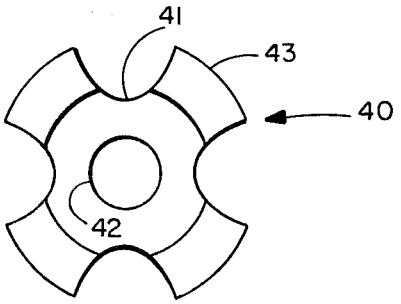
FIG. 4 is a plan view of a disc member utilized in the joystick apparatus of FIG. 1.

A generally planar disc member identified by reference numeral 40 is slideably confined between surfaces 35 and 38. Disc member 40 includes a flexible center web 41 surrounding shaft 11. As apparent from FIGS. 1–3, and as shown in FIG. 4, web 41 has an aperture 42 therethrough which is sized to snugly receive an end of shaft 11. Web 41 is shown partially surrounded by a thickened rim 43. Rim 43 has a thickness substantially equal to the spacing between surfaces 35 and 38. Notches are provided in the periphery of disc member 40 to accommodate posts 37 while providing adequate freedom for the disc member to slide between surfaces 35 and 38.

Figure 5:
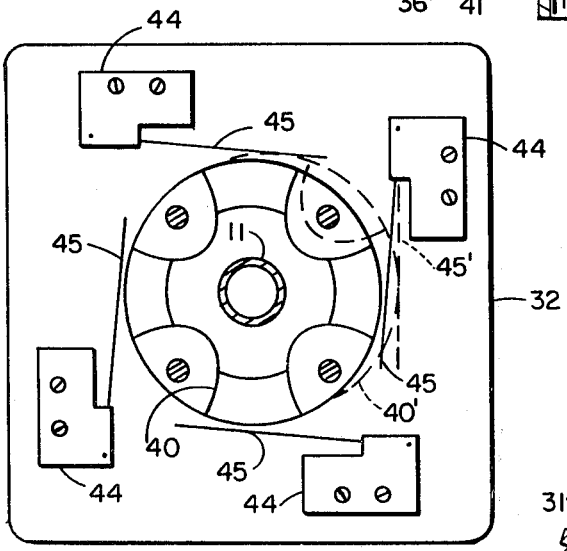
FIG. 5 is a sectional view of the joystick apparatus of FIG. 1 taken along line 5—5 in FIG. 2.

As shown in detail in FIG. 5, a plurality of commercially available miniature limit switches 44 are mounted on plate 32 around the perimeter of disc member 40. Each switch is shown as having a leaf operator 45 including a planar portion of substantial lateral extent generally tangent to the periphery of disc member 40. As disc member 40 is moved laterally, as illustrated by dashed outline 40', the periphery of the disc member contacts one (or more) of leaf operators 45 and displaces it as shown by numeral 45', thus actuating the associated switch. Since disc member 40 can be moved in any direction in its plane of movement, it is apparent that more than one of switches 44 may be actuated simultaneously depending on the direction of movement of shaft 11 and resultant movement of the disc member. Thus, it can be seen that any of switches 44 may be actuated by movement of shaft 11 having a significant component in the direction necessary to actuate the switch. Although a plane leaf operator is shown for the switches, a similar result is obtainable with roller equipped leaf operators or other types of switch or valve operators.

In accordance with the foregoing description, the applicant has provided a unique joystick actuator motion conversion mechanism which is simple and compact and permits independent actuation of one or more of a plurality of standard commercially available switches or transducers. Although a particular embodiment has been shown and described for illustrative purposes, a number of variations and modifications will be apparent to those familiar with the relevant arts. It is intended that coverage of the invention not be limited to the embodiment shown, but only by the terms of the following claims.

The embodiments of the invention in which an exclusive property or right is claimed are defined as follows:

1. An actuator mechanism for converting two axis pivoting motion to planar motion comprising:

a shaft extending along a longitudinal axis and mounted by first support means for pivotal movement about two distinct axes transverse to the longitudinal axis at a pivot point thereon;

a disc member connected to said shaft at a location spaced from the pivot point; said disc member comprising a flexible central web at least partially surrounded by a peripheral rim; and second support means for supporting said disc member generally in a plane transverse to the longitudinal axis and confining said peripheral rim of said disc member to movement in the plane.

2. The actuator mechanism of claim 1 wherein:

said disc member is connected to said shaft by means of an aperture through the central web sized to snugly fit over an end of said shaft whereby pivotal movement of said shaft is transmitted to said rim by said flexible web which permits movement of said rim to be confined to the plane.

3. The actuator mechanism of claim 2 wherein said second support means comprises structure having a pair of spaced parallel surfaces transverse to the longitudinal axis and between which said rim is slideably supported, and said rim of said disc member is configured with parallel surfaces and has a thickness substantially equal to the spacing between the parallel surfaces of said second support means.

4. The actuator mechanism of claim 3 wherein said first and second support means comprise a portion of a housing in which said shaft is mounted, and wherein said first support means mounting said shaft in said housing is a gimbal.

5. The actuator mechanism of claim 1, 3 or 4 further including transducer means actuatable by linear motion mounted on said second support means and positioned for actuation by the rim of said disc member.

6. The actuator mechanism of claim 5 wherein said transducer means comprises a plurality of electrical switches spaced around said disc member.

7. A mechanism for converting two axis pivoting motion to planar motion comprising:

a generally planar disc member including a flexible portion and a generally rigid portion;

a housing for supporting said disc member, said housing having a cavity therein in which said disc member is located, the cavity being configured to permit sliding movement of said disc member in any direction in the plane thereof and to confine movement of the rigid portion of said disc member to the plane;

a shaft;

mounting means for pivotally mounting said shaft in said housing so that said shaft extends longitudinally along a first axis transverse to the plane of said disc member, said mounting means providing for pivotal movement of said shaft about distinct second and third axes transverse to said first axis at a pivot point between the ends of the shaft; and connecting means for joining said shaft to the flexible portion of said disc member at a location spaced from the pivot point, whereby pivoting of said shaft imparts planar motion to the rigid portion of said disc member through said flexible portion of said disc member.

8. The mechanism of claim 7 wherein said connecting means comprises a central aperture in the flexible portion of said disc member and a portion of said shaft which extends into the aperture.

9. The mechanism of claim 8 wherein the aperture in said disc member is sized to snugly receive the end of said shaft.

10. The mechanism of claim 9 wherein the flexible portion of said disc member is a web, said rigid portion of said disc member at least partially surrounds said flexible web and comprises a thickened rim.

11. The mechanism of claim 10 wherein:

the thickened rim of said disc member has a pair of spaced sides parallel with the plane of said disc member; and the cavity in said housing includes a pair of surfaces parallel with the plane of said disc member and spaced apart by substantially the same distance as the sides of said disc member.

12. The apparatus of claim 7 or 11 in which said mounting means comprises a gimbal for pivotally mounting said shaft in said housing.

13. A mechanism for actuating transducer means in response to pivoting shaft motion comprising:

a shaft having a first end adapted for manual movement and a second end for supplying a responsive motion for actuating transducer means actuatable by linear motion;

a generally planar disc member including a flexible portion and a rigid portion;

a housing for supporting said shaft and said disc member, said housing having a cavity therein in which said disc member is located, said cavity being configured to permit sliding movement of said disc member in any direction in the plane thereof and to confine movement of the rigid portion of said disc member to the plane;

mounting means for pivotally mounting said shaft in said housing so that said shaft extends along a first axis transverse to the plane of said disc member, said mounting means permitting pivotal movement of said shaft about distinct second and third axes transverse to said first axis at a pivot point between the first and second ends of said shaft, whereby movement of the first end of said shaft results in pivotal movement of said shaft about the pivot point;

connecting means joining said shaft to the flexible portion of said disc member at a location spaced from the pivot point, whereby pivoting of said shaft imparts planar motion to the rigid portion of said disc member through said flexible portion of said disc member; and transducer means having operator means positioned proximate the periphery of said disc member, whereby said transducer means may be actuated by manual movement of the first end of said shaft.

14. The mechanism of claim 13 wherein:

at least a portion of the periphery of said disc member is circular and concentric with the first axis; and the operator means on said transducer means includes a planar portion having a substantial lateral extent in the plane of said disc member along a line tangent to the periphery thereof, whereby said transducer means may be actuated by any movement of the first end of said shaft having a significant component in the direction necessary to actuate said transducer means.

15. The mechanism of claim 14 in which said transducer means comprises a plurality of electrical switches.

16. The mechanism of claim 13 wherein said connecting means comprises a central aperture in the flexible portion of said disc member for receiving the second end of said shaft.

17. The mechanism of claim 16 wherein:

the aperture in said disc member is sized to snugly receive the second end of said shaft.

18. The mechanism of claim 17 wherein the flexible portion of said disc member is at least partially surrounded by the rigid portion which constitutes a thickened rim.

19. The mechanism of claim 18 wherein:

the thickened rim of said disc member has first and second surfaces thereon parallel with the plane of said disc member; and the cavity in said housing includes first and second parallel surfaces spaced apart by substantially the same distance as the thickness of said thickened rim.

20. The mechanism of claim 19 in which said transducer means comprises a plurality of electrical switches, each having an operator located proximate the periphery of said disc member, whereby selected ones of said plurality of electrical switches may be actuated depending on the direction of movement of the first end of said shaft.

* * * * *